US007174991B1

(12) United States Patent
Gunnarsson et al.

(10) Patent No.: US 7,174,991 B1
(45) Date of Patent: Feb. 13, 2007

(54) MUFFLER FOR INTERNAL COMBUSTION ENGINE

(75) Inventors: Peter Gunnarsson, Gränna (SE); Esbjörn Ollas, Huskvarna (SE); Mattias Ossiansson, Huskvarna (SE)

(73) Assignee: Aktiebolaget Electrolux, Stockholm (SE)

( * ) Notice: Subject to any disclaimer, the term of this patent is extended or adjusted under 35 U.S.C. 154(b) by 274 days.

(21) Appl. No.: 10/415,728

(22) PCT Filed: Nov. 3, 2000

(86) PCT No.: PCT/SE00/02158

§ 371 (c)(1),
(2), (4) Date: Jul. 7, 2003

(87) PCT Pub. No.: WO02/36942

PCT Pub. Date: May 10, 2002

(51) Int. Cl.
*F01N 3/02* (2006.01)
*F01N 3/06* (2006.01)
*F01N 1/08* (2006.01)
*F01N 7/08* (2006.01)

(52) U.S. Cl. ..... 181/231; 181/265; 60/312; 60/324

(58) Field of Classification Search ..... 181/231, 181/229, 230, 265, 266, 268, 273, 275
See application file for complete search history.

(56) References Cited

U.S. PATENT DOCUMENTS 2,961,058 A * 11/1960 Carter ..... 181/229
3,650,354 A 3/1972 Gordon
3,968,854 A * 7/1976 Gordon et al. ..... 181/269
4,142,607 A 3/1979 Landwehr et al.
4,164,989 A * 8/1979 Lux et al. ..... 181/265
4,418,790 A * 12/1983 Agnew ..... 181/268
5,109,949 A * 5/1992 Sato et al. ..... 181/240
5,315,075 A * 5/1994 Junginger et al. ..... 181/240
5,339,629 A * 8/1994 Winberg et al. ..... 60/299
5,440,083 A * 8/1995 Masuda ..... 181/240
5,651,249 A * 7/1997 Nagao et al. ..... 60/302
5,732,555 A 3/1998 Gracyalny et al.
5,857,327 A * 1/1999 Sato et al. ..... 60/302

(Continued)

FOREIGN PATENT DOCUMENTS

DE 2643242 A1 * 3/1978

(Continued)

*Primary Examiner*—Edgardo San Martin
(74) *Attorney, Agent, or Firm*—Pearne & Gordon LLP

(57) ABSTRACT

The subject invention refers to a muffler comprising a muffler housing (1, 2) and generally a catalytic converter element (13) mounted in the housing, which muffler has at least one inner outlet (4) through which exhaust gases cleaned by the catalytic element (13) are intended to pass. Furthermore, according to the invention an outlet duct (30, 31) is arranged in connection to the outside of the housing, comprising a first section (30) for leading exhaust gases in a first direction (A) in parallel with the outside of the housing, and a second section (31) for leading exhaust gases in a second, opposite direction (B), whereby said first and second sections (30, 31) have an essentially equally large cross-sectional area. By way of this outlet duct an improved cooling of the exhaust gases before they are brought in contact with fresh air rich in oxygen can be achieved. A back-pulsation of fresh air into the muffler can also be prevented.

6 Claims, 3 Drawing Sheets

U.S. PATENT DOCUMENTS 5,857,329 A * 1/1999 Bigham ..... 60/317
5,866,859 A * 2/1999 Karlsson et al. ..... 181/230
5,877,461 A * 3/1999 Karlsson et al. ..... 181/230
5,883,342 A 3/1999 Wolpert
6,109,026 A * 8/2000 Karlsson et al. ..... 60/302
6,164,066 A * 12/2000 Sakaguchi et al. ..... 60/302
6,250,075 B1 * 6/2001 Funakoshi et al. ..... 60/299
6,393,835 B1 * 5/2002 Stoll et al. ..... 60/299
6,457,553 B1 * 10/2002 Goplen et al. ..... 181/272
2003/0173148 A1 * 9/2003 Andersson et al. ..... 181/272

FOREIGN PATENT DOCUMENTS

JP 11156802 A * 6/1999
WO WO00/08315 2/2000

* cited by examiner

MUFFLER FOR INTERNAL COMBUSTION ENGINE

This application claims the benefit of International Application Number PCT/SE00/02158, which was published in English on May 10, 2002.

TECHNICAL FIELD

The subject invention refers to a muffler comprising a muffler housing and generally a catalytic converter element mounted in the housing, said muffler has at least one inner outlet through which exhaust gases are intended to pass.

BACKGROUND OF THE INVENTION

Cleaning of exhaust gases by using catalytic converters has nowadays become more and more common even in smaller internal combustion engines of two-stroke type, e.g. in handheld power-driven working tools, such as chain saws and grass trimmers. Demands concerning weight and size of the exhaust cleaning equipment have led to the development of so called catalytic mufflers which are mounted directly to the exhaust port of the cylinder. A typical catalytic muffler has a sealed housing with an inlet as well as an outlet port, and a catalytic element mounted in the housing for cleaning the exhaust gases leaving the muffler. Furthermore it is often advantageous to release the exhaust gases through the lid of the muffler, see WO9602741.

A consequence of the introduction of catalytic conversion is that the temperature of the exhaust gases has increased considerably owing to the reactions in the catalytic converter. The compact design of the above-mentioned type of catalytic muffler results in that the exhaust gases will leave the muffler relatively soon after they have passed through the catalytic converter, and thus extremely hot exhaust gases are released from the muffler. Furthermore it is common that the plate parts of the muffler will enclose the catalytic converter element relatively tight, and so called "hot spots", i.e. surface areas of the catalytic element getting an extremely high temperature, can spread even to surrounding plate parts. When fresh air, i.e. air rich in oxygen surrounding the engine, comes into contact with the extremely hot exhaust gases, or with these "hot spots", flames could occur. This could lead to an increased risk of fire, particularly since this type of smaller engines are often used in tools handled in fire risk environments with plenty of inflammable material.

In order to essentially eliminate the risk of fire caused by sparks a catalytic muffler of this kind is often equipped with a spark-arrester screen, which even is a requirement in US-legislation. For obtaining a satisfactory result the spark-arrester screen must be so fine-meshed that it gets a relatively short lifetime. However, such a spark-arrester screen can only to a limited extent put out flames.

PURPOSE OF THE INVENTION

A purpose of the present invention is thus to achieve a muffler that minimizes the risk of flaming at the exhaust outlet.

A second purpose is to achieve a muffler providing an improved cooling of the exhaust gases before these are brought in contact with fresh air.

SUMMARY OF THE INVENTION

These and other purposes of the invention are achieved in a muffler of the initially mentioned kind, in which an outlet duct is arranged in connection to the outside of the housing, said outlet duct comprises a first section arranged to conduct the exhaust gases in a first direction in parallel with the outside of the housing, and a second section arranged to conduct the exhaust gases in a second, opposite direction, whereby said first and second sections have an essentially equally large cross-section area and will forward the exhaust gases up to a mouth. The invention is mainly intended for mufflers equipped with a catalytic converter. However, it is also applicable for engines generating especially hot exhaust gases for other reasons.

This outlet duct is not to be mistaken for the type of guide plate for fresh air that is shown in WO9602741. This guide plate is located completely outside the muffler housing and is adapted to guide the fresh air past the exhaust outlet in order to thereby cool down and spread out the exhaust gases. Even though the exhaust gases by means of the guide plate are forced to change direction by 180 degrees, this change of direction will occur first after the exhaust gases have passed through the outlet and thus been brought in contact with fresh air.

Instead, according to the subject invention a closed outlet duct from the inner outlet of the muffler up to the mouth is created, and first on the outside of said mouth fresh air from the outside can be brought in contact with the exhaust gases. Fresh air is thereby efficiently prevented from coming in contact with the over-heated surfaces ("hot spots") of the catalytic element as well as the surrounding plate surfaces inside the muffler, by so called back-pulsation.

Furthermore, since the exhaust gases are forced to pass through the two-way directed labyrinth forming the outlet duct, said exhaust gases will be sufficiently cooled to prevent any flames from occurring at the mouth of the duct. It is hereby advantageous if the labyrinth is located outside the muffler housing to provide an especially good cooling.

Both opposed directed sections of the outlet duct have an essentially equally large cross-section area, i.e. the area of the downstream section represents 50–200% of the upstream section and preferably 70–150%. Hereby there will not be any larger pressure difference over the curve that is the result of the change of direction. Thereby a substantial back-pressure can be maintained right up till when the exhaust gases are leaving the mouth.

A spark-arrester screen can be arranged between the inner outlet of the muffler and the outlet duct for arresting sparks brought by the exhaust gases. The spark-arrester screen can also be arranged in the outlet duct or at the very exhaust outlet. Thereby a combination of spark-arrester and outlet labyrinth is achieved, thus providing a satisfactory elimination of both sparks and flaming.

The outlet duct is preferably orientated in parallel with the outer wall of the muffler housing. This orientation is advantageous from considerations of space as well as for the functioning of the outlet duct. The cooling can be improved in that the outlet duct is located at the same level as the outside of the muffler. Furthermore, since the first section is orientated along the muffler housing a relatively substantial change of the flow direction will occur already when the exhaust gases are arriving at the first section. The change of direction between the first and the second section will thereby become even more effective. For the same reason it is particularly preferable that the second section is located outside the first section counted from the housing, so that the sections are located outside each other.

According to a preferred embodiment the first section is embodied of a first curved, elongated baffle (duct) having an end-gable located at the inner outlet and an aperture located at a distance from this, and the second section is embodied of a second curved baffle having an end-gable located at said aperture, and a mouth located along the first baffle, whereby the second section is embodied of a space created in between said first and second baffles. The labyrinth, which is created in this manner has been found to function satisfactory, and both parts can easily be mounted tight to the muffler housing. Both baffles can easily be adapted considering curving and length in order to achieve an optimal outlet labyrinth.

A bulge can be arranged on the first baffle, i.e. outside said mouth, so that the exhaust gases released from the mouth will be spread out by the bulge. Owing to the fact that the outflowing exhaust gases are spread out the still comparatively hot exhaust gases will be prevented from following a single flow with a high temperature. The outspread exhaust flow will simply be cooled down faster since it will be brought in contact with a greater volume of ambient air.

The outlet duct is according to an especially preferred embodiment preferably orientated in a crosswise direction of the cylinder of the engine.

BRIEF DESCRIPTION OF THE DRAWINGS

A preferred embodiment of the present invention will in the following for the purpose of exemplifying be described in greater detail with reference to the accompanying drawing figures.

DESCRIPTION OF PREFERRED EMBODIMENTS

Figure 1:
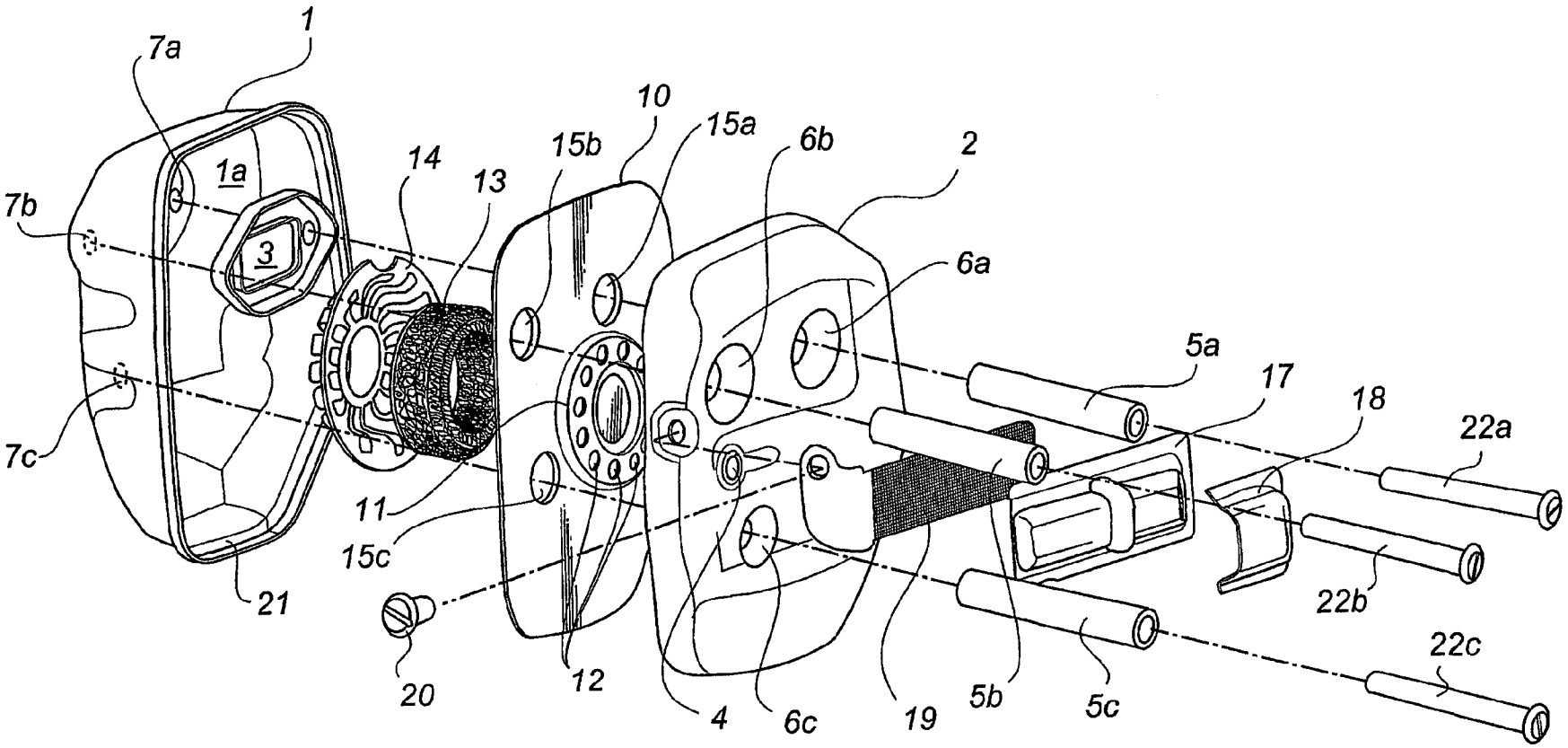
FIG. 1 shows in an exploded view a catalytic muffler equipped with an outlet duct according to an embodiment of the invention.

The catalytic muffler shown in FIG. 1 in an exploded view is in itself of a known type, however equipped with an outlet duct according to an embodiment of the invention. The muffler comprises a housing 1, 2 consisting of a housing 1 and a lid 2, preferably made from a thin metal sheet or another material with similar characteristic features. The housing 1 is intended to be mounted to an exhaust outlet of an engine cylinder (not shown), and has therefore an inlet 3, while the lid 2 has an inner outlet 4 for the exhaust gases cleaned by the catalytic converter. Distance elements 5*a–c* are arranged between the housing 1 and the lid 2, and are intended to penetrate through for the purpose configured apertures 6*a–c* in the lid 2 and to support against the rear wall of the housing 1 around apertures 7*a–c*.

Between the housing 1 and the lid 2 an intermediate wall 10 is arranged, having an annular area 11 with apertures 12, at which an annular catalytic converter element 13 is intended to be mounted by means of a ring-shaped covering element 14 provided with apertures. The intermediate wall 10 also has three larger apertures 15*a–c*, intended to be penetrated by the distance elements 5*a–c*.

On the outside of the lid 2 an outlet duct in the form of a "labyrinth" 17, 18 is located, consisting of two sections directed opposed each other. In the shown example each section is separated by a curved divider 17, 18, or baffle made of plate material, which will be described more in detail in the following. Between the lid 2 and the labyrinth 17, 18 a spark-arrester screen 19, of an in itself known type, is arranged by means of attachment means 20.

The catalytic muffler according to FIG. 1 can be mounted in the following way:

Initially the catalytic element 13 is placed onto the intermediate wall 10 and thereafter the covering element 14 is mounted to the wall. The ring-shaped covering element 14, which preferably in similarity with the intermediate wall is made of plate material, can be soldered or welded onto the intermediate wall 10, with the catalytic element 13 located in between. Thereafter the intermediate wall 10 together with the catalytic element will be placed into the housing, where it will support against a stop 21 extending around the housing.

At the lid 2 the parts of the labyrinth 17, 18 will be soldered or spot-welded, so that the outlet duct is created. In the one end of the labyrinth, preferably that in connection to the inner outlet 4 from the lid, there should be left an opening, into which the spark-arrester screen 19 can be inserted and attached by means of a screw 20 or similar. By this design the spark-arrester screen can easily be replaced if required, or also be dismantled if desired.

The lid with the labyrinth 17, 18 can now be arranged at the housing 1, i.e. above the intermediate wall 10, which thereby will be clamped between the housing 1 and the lid 2, and then be fastened in a suitable way, e.g. by welding or soldering. Thereafter the distance elements 5*a–c* are inserted through apertures 6*a–c* in the lid and welded together in a position where they stop against inner wall 1*a* of the housing 1, said distance elements are preferably made of metal sleeves resistant to pressure in a longitudinal direction. The distance elements 5*a–c* can thereby be used to attach the muffler onto an engine cylinder (not shown) by means of penetrating attachment means 22*a–c*.

Figure 2:
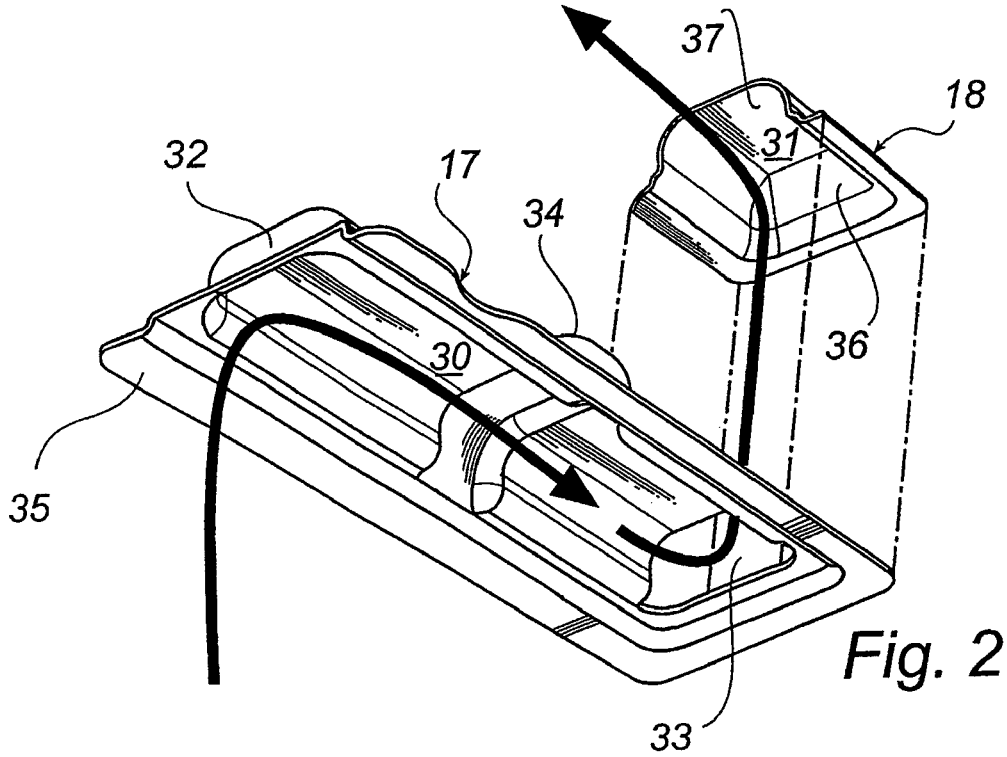
FIG. 2 illustrates the parts of the outlet duct according to FIG. 1 in an exploded view from below.
Figure 3:
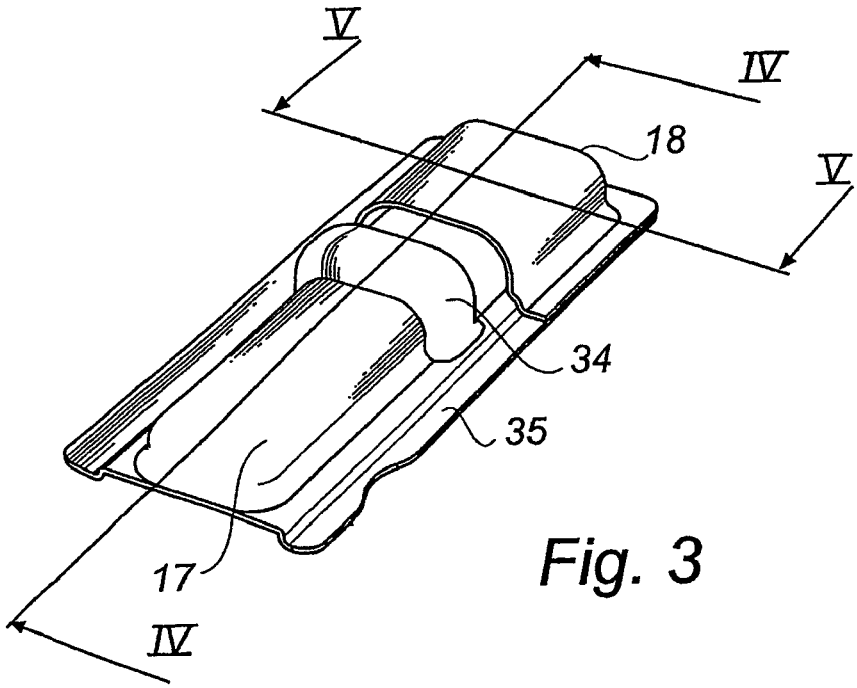
FIG. 3 illustrates the outlet duct according to FIGS. 1 and 2 in an assembled condition.
Figure 4:
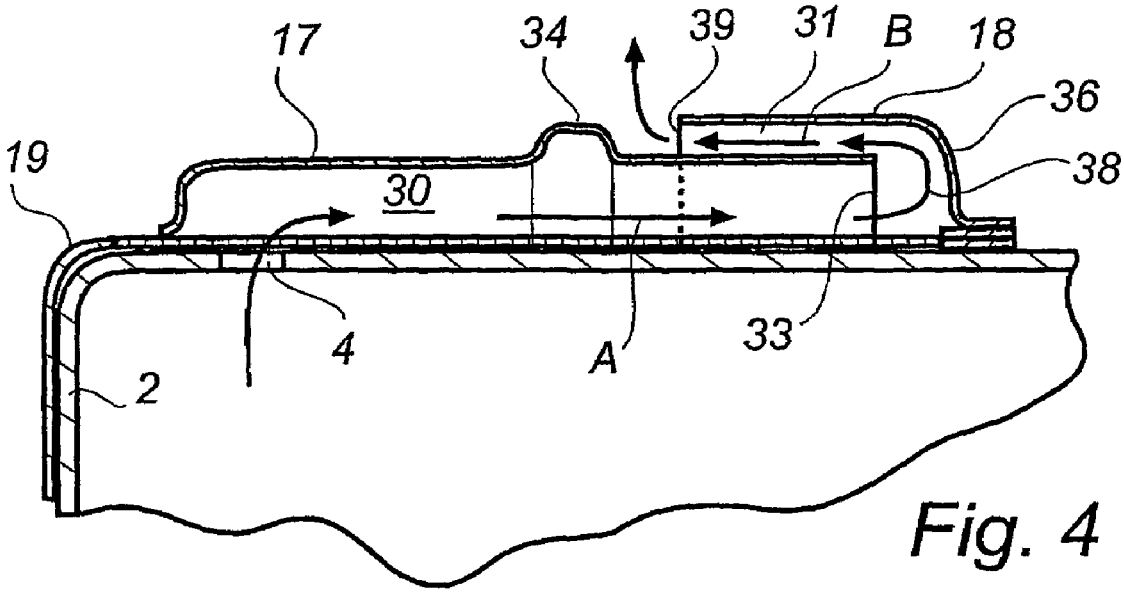
FIG. 4 shows the outlet duct in a cross-section along the line IV—IV according to FIG. 3.
Figure 5:
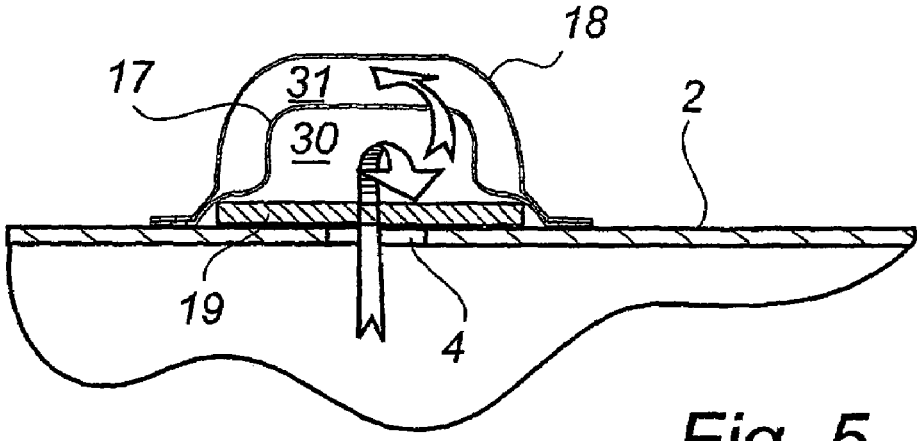
FIG. 5 shows the outlet duct in a cross-section along the line V—V according to FIG. 3.

In FIG. 2 the curved baffles 17, 18 which are forming the labyrinth of the outlet duct, are shown in an inversed view where it becomes more evident how the duct sections, which in the FIGS. 2–5 are designated by reference numerals 30 and 31, are created. The first baffle 17 is elongated and has one short side that is sealed by end wall 32 and has an aperture 33 in its other short side. At a location between the both short sides of the baffle a bulge 34 is created since the curving is higher at this location. Furthermore, around the entire baffle a flange 35 extends for enabling fastening of the baffle in a simple way onto the outside of the muffler housing. The other baffle 18 is shorter, and has a somewhat higher curving, however, in similarity with the first baffle it has an end wall 36 and an aperture 37. Furthermore, it is adapted to be mounted above the first baffle 17 and has its end wall 36 located at some distance outside the aperture 33 of the first baffle 17, and has its aperture 37 located between the bulge 34 and the aperture 33. The baffles are in this position mounted as shown in FIGS. 3–5.

The above-mentioned outlet duct's first section 30 is thus delimited by the muffler lid 2 and the first baffle's curved inside, and the duct's other section 31 is embodied of a space in between the baffles created by their respective curving. Owing to the fact that the second baffle's end wall 36 is located at a distance outside the first baffle's aperture 33, a curve 38 that connects the two sections 30, 31 is hereby created. The second section 31 ends up in a mouth 39 having an essentially U-shaped cross-section. The extension of the outlet duct is most clearly illustrated in FIG. 4.

Consequently, as illustrated in FIG. 5 the first section 30 has an essentially rectangular cross-section, while the second section 31 has an essentially U-shaped cross-section. A characteristic feature of the present invention is that both sections, in spite of their different cross-sectional shapes, have an essentially equally large cross-sectional area.

During operation uncleaned exhaust gases are led from the engine's cylinder outlet into the muffler's first chamber, located between the housing 1 and the intermediate wall 10, and are forced to pass the catalytic element 13 through the apertures of the covering element 14 as well as the intermediate wall 10. The in this way cleaned and very hot exhaust gases are thereby led into the second chamber of the muffler, located between the intermediate wall 10 and the lid 2, and then out through the outlet 4. Where applicable the exhaust gases pass through the spark-arrester screen 19 where possible following sparks can be arrested, thereafter the exhaust gases arrive at the outlet duct 17, 18 according to the present invention.

The exhaust gases will now follow the way shown in FIG. 4, in a first direction A along the first section 30, through the aperture 33, around the curve 38, and then in the other direction B along the second section 31, and finally out through the mouth 39. Outside said mouth the exhaust gases will flow towards the bulge 34, which then will spread them out.

It is evident for the skilled man that the above described embodiment can be modified in many different ways within the scope of the appended patent claims, e.g. the illustrated muffler is only one of a number of conceivable variants, with different shape and design of the housing, as wells as the location of a possible catalytic element and the flow path of the exhaust gases.

Furthermore, the outlet duct with its two opposed directed sections 30, 31 can be embodied in many different ways. E.g. the sections can be located side by side instead of outside each other, or can also have another shape than the one illustrated here. The outlet duct can also be immersed, either completely or partly, in relation to the outside of the housing, e.g. the first section can be created between an immersed part of housing's outside and a covering plate. Alternatively, one or two internal plates could create the first section 30, and possibly also the second section 31 of the outlet duct together with the housing. This would lead to a less effective cooling of the exhaust gases. Furthermore, the muffler could have one or several exhaust outlets located on one or several sides of the muffler. The exhaust outlets could also be of a mutually different type.

The invention claimed is:

1. A muffler comprising a muffler housing (1, 2) consisting of a housing (1) and a lid (2) or cover (2) having at least one inner outlet (4) for exhaust gases cleaned by a catalytic converter element (13) mounted in the housing, said muffler has an outlet duct (30, 31) through which exhaust gases are intended to pass, characterized in that the outlet duct (30,31) is arranged downstream of the inner outlet (4) and located on the outside of the lid (2) to provide an especially good cooling, said outlet duct comprises a first section (30) arranged to lead exhaust gases in a first direction (A) in parallel with the outside of the lid (2), and a second section (31) arranged to lead exhaust gases in a second, essentially opposite direction (B), and said second section (31) is located outside said first section (30), counted from the lid (2), and said first and second sections (30,31) have an essentially equally large cross-sectional area and will forward the exhaust gases up to a mouth (39).

2. A muffler according to claim 1, whereby the outlet duct (30,31) is orientated in parallel with the outer wall of the muffler housing (2).

3. A muffler according to claim 2, whereby said first section (30) is embodied of a first curved, elongated baffle (17) having an end-gable (32) located at the inner outlet (4) and an aperture (33) located at a distance from the outlet (4) and whereby said second section (31) is embodied of a second curved baffle (18) having an end-gable (36) located at said aperture (33), and a mouth (39) located along the first baffle (17), whereby said second section is embodied of a space (31) created in between said first and second baffles (17,18).

4. A muffler according to claim 3, whereby a bulge (34) is created on the first baffle (17) located outside said mouth (39), so that the exhaust gases released from the mouth (39) will be spread out by the bulge (34).

5. A muffler according to any one of the preceding claims, whereby the outlet duct (30,31) is orientated in a crosswise direction to the direction of the cylinder of the engine.

6. A muffler according to claim 1, whereby a spark arrester screen (19) is mounted between the muffler's inner outlet (4) and the outlet duct (30,31).

* * * * *